US005865271A

United States Patent [19]

Shalders

[11] Patent Number: 5,865,271

[45] Date of Patent: Feb. 2, 1999

[54] TELESCOPIC LEDGER FOR SCAFFOLDING

[75] Inventor: Alan J. Shalders, North Salem, N.Y.

[73] Assignee: Universal Builders Supply, Inc., Mount Vernon, N.Y.

[21] Appl. No.: 990,948

[22] Filed: Dec. 15, 1997

[51] Int. Cl.[6] ..... E04G 5/00

[52] U.S. Cl. ..... 182/222; 182/179.1; 52/726.2

[58] Field of Search ..... 182/119, 222, 182/179.1; 52/223.9, 223.11, 645, 651.1, 726.2, 731.1

[56] References Cited

U.S. PATENT DOCUMENTS

| | | | |
|---|---|---|---|
| 444,579 | 1/1891 | Jackson | 52/726.2 |
| 1,415,554 | 5/1922 | Hatch | 182/222 |
| 3,108,663 | 10/1963 | Glaser | 52/726.2 |
| 3,247,639 | 4/1966 | Rambelje | 52/726.2 |

*Primary Examiner*—Alvin Chin-Shue
*Attorney, Agent, or Firm*—Baker & Botts, LLP

[57] ABSTRACT

A telescopic ledger for scaffolding comprises an elongated ledger member of substantially uniform I-shape in cross section along its length, a front coupling sleeve attached to the ledger member adjacent its front end, and a channel assembly having a pair of elongated channel members and a rear coupling sleeve attached to the channel members proximate to their rear ends. The channel members are of the same substantially uniform U-shaped cross section along their lengths, each channel member having a web portion and side flange portions joined to and extending from side edges of the web portion. The channel members are joined to each other by the rear coupling sleeve in spaced-apart relation with their web portions in opposed relation and defining a cavity and with the side flange portions defining a gap. A portion of the ledger member adjacent to the front end is received in telescopic relation to portions of the channel members adjacent the rear ends of the channel members. The front coupling sleeve and the channel members are in close sliding relation for transfer of loads from the channel members to the first coupling sleeve. The rear coupling sleeve and the ledger member are, similarly, in close sliding relation for transfer of loads from the ledger member to the rear coupling sleeve.

21 Claims, 3 Drawing Sheets

TELESCOPIC LEDGER FOR SCAFFOLDING

BACKGROUND OF THE INVENTION

One form of scaffolding for receiving materials and providing work platforms for workers at selected vertical levels adjacent to a structure being worked on is a modular structural system that includes load-bearing panels stacked vertically and forming vertical columns, horizontal landing channels at each level that are affixed perpendicular to and supported by the columns, and horizontal joists or "ledgers," which are parallel to the columns, perpendicular to the landing channels, and supported by and affixed to the landing channels. Each load-bearing panel is usually a planar truss that has two tubular posts, which are joined by cross members and diagonal braces. The stacks of load-bearing panels that form the columns are arranged in pairs, each column of each pair being parallel to the building face and one column of each pair being closer to the building face than the other. The pairs of columns are spaced apart laterally, and each column is joined to an adjacent column by cross-bracing trusses that are also parallel to the building face.

The modular scaffolding system thus consists of stacks of rectangular bays of two forms. One form of bay, a "load-carrying bay," has two sides parallel to the building face, each of which is a load-bearing panel having a tubular post at each end, and two sides perpendicular to the building face formed by landing channels. Commonly, each landing channel is "sistered" with a cantilevered extension channel, which has a portion coextensive with the landing channel and a cantilevered portion that extends toward the building from the structural bay and supports a cantilevered deck portion of a width of, say, four feet for workers to move freely from place to place along the structure being worked on. The other form of bay, a "cross-truss bay," is located between each adjacent pair of load-carrying bays and usually consists of cross trusses that are co-planar with and joined to the stacks of load-bearing panels that form the columns of the adjacent load-carrying bays. The ledgers span both the load-carrying bays and the cross-truss bays and receive decking.

Each vertical stack of load-carrying bays is essentially a hollow vertical tower that is self-supporting, provided that it is suitably fastened to the building at intervals. Therefore, it is possible for a scaffolding to include adjacent load-carrying towers that are independent of each other, that is, not connected by cross-bracing parallel to the building. It is also possible to construct scaffolding composed of units that consist of two or more load-bearing towers, the adjacent towers of each unit being spaced apart and joined by cross-bracing trusses. Adjacent side-by-side towers or multiple tower units may be relatively widely spaced apart, such that standard ledgers are not strong enough to span the spacing. It is, of course, possible to provide special ledgers that are stronger than the standard ledgers to span greater distances between scaffolding towers. Generally, such special, stronger ledgers may not integrate well with a modular system that uses standard ledgers and other standard parts and increase the cost of the scaffolding.

An exemplary scaffolding system is described and shown in U.S. Pat. No. 5,135,077 issued Aug. 4, 1992, and entitled "Scaffolding System," which is hereby incorporated into the present specification for all purposes.

One object of the present invention is to provide a way of supporting decking across spans between adjacent scaffold towers that are spaced so widely apart as to preclude the use of standard ledgers. Another object is to provide long ledgers that use standard ledgers as their principal components. Still a further object is to provide long ledgers that not only use standard ledgers but do so without modifying them in any way, thus permitting the standard ledgers to be used normally or in a long ledger. It is also desired to provide long ledgers that integrate readily into a scaffolding system that uses standard ledgers.

SUMMARY OF THE INVENTION

The foregoing objects are attained, in accordance with the present invention, by a telescopic ledger for scaffolding that comprises an elongated ledger member of substantially uniform I-shape in cross-section along its length, a front coupling sleeve attached to the ledger member adjacent its front end, and a channel assembly having a pair of elongated channel members and a rear coupling sleeve attached to the channel members proximate to their rear ends. The channel members are of the same substantially uniform U-shaped cross section along their lengths, each channel member having a web portion and side flange portions joined to and extending from side edges of the web portion. The channel members are joined to each other by the rear coupling sleeve in spaced-apart relation with their web portions in opposed relation and defining a cavity and with the side flange portions defining a gap. A portion of the ledger member adjacent to the front end is received in telescopic relation to portions of the channel members adjacent the rear ends of the channel members. The front coupling sleeve and the channel members are in close sliding relation for transfer of loads from the channel members to the first coupling sleeve. The rear coupling sleeve and the ledger member are, similarly, in close sliding relation for transfer of loads from the ledger member to the rear coupling sleeve.

The channel assembly provides an extension for the standard ledger thus providing a "long" ledger that can be installed across a span that is greater than normal. The telescopic relationship between the ledger and the channel assembly allows the overall length of the long telescopic ledger to be varied to suit a particular installation. The present invention enables a standard ledger to be extended in length without modifying the ledger in any way, such as by making holes for splice plates or welding or otherwise permanently affixing any elements to it. The front sleeve is readily removed to restore the ledger to its original form for normal use. The channel members may be of standard profiles, that are commercially available, which saves costs. The couplings are specially made but are of relatively simple design and low cost.

In order to integrate a telescopic ledger embodying the invention into a scaffolding system, another ledger having a front coupling sleeve installed on or near one end may be fitted in telescopic relation to the free front end of the channel assembly of the telescopic ledger. The end of the ledger of the telescopic (extended) ledger and the end of the second ledger that is telescopically fitted to the end of the channel assembly of the telescopic ledger are supported on and affixed to landing channels of adjacent load-bearing towers of the scaffolding in the usual manner. Other ways of joining the front end of the channel assembly to a landing channel are, of course, possible.

In preferred embodiments of the telescopic ledger according to the present invention, the ledger member has a pair of upper flanges and a pair of lower flanges, and the respective channel members of the channel assembly are received between an upper flange and a lower flange of the ledger member. The front coupling sleeve, which is attached to the front end of the ledger member, includes a tubular body of uniform rectangular cross-section having upper and lower walls in close sliding fit with the upper and lower flanges of the ledger member, so that it can be slid onto the end of the ledger member. The tubular body member of the front coupling sleeve further includes opposite side walls joining the upper and lower walls and forming corners, and the front coupling sleeve further includes packing blocks affixed to the body member in the corners, the packing blocks being shaped and dimensioned to form a close sliding fit with the side flanges of the channel members. Also, the side walls of the tubular body member of the front coupling sleeve are in a close sliding fit with the web portions of the channel members. The ledger includes a bolt-head groove between the lower flanges, and the front coupling sleeve is affixed to the ledger member by at least one bolt received by the bolt-head groove, passing through a hole in the tubular body member, and receiving a nut.

In a preferred embodiment, furthermore, the rear coupling sleeve, which is part of the channel assembly, includes a tubular body member that is of uniform substantially rectangular cross section and has upper and lower walls that are in close sliding fit with the upper and lower flanges of the ledger member. The tubular body member of the rear coupling sleeve has side walls joining the upper and lower walls and is fastened to the channel members by bolts passing through holes in the side walls of the body member and the webs of the channel members and nuts threaded onto the bolts. Portions of the side flanges of the channel members substantially coextensive with the body member of the rear coupling sleeve have packing blocks affixed to them, the packing blocks being in close sliding fit with the upper and lower flanges of the ledger member. The front ends of the channel members can be joined in various ways, such as by a spacer tube received between the webs of the channel members, a bolt passing through holes in the webs of the channel members and the spacer tube, and a nut threaded onto the bolt, the spacer tube and bolt being proximate to a front end of the channel assembly remote from the rear coupling sleeve. A wood nailing strip of I-shaped cross section that extends from the front coupling sleeve to the free front ends of the channel members is slid endwise into the gap between the channel members. One or more spacer clips may be inserted between the channel members. A suitable spacer clip includes a generally U-shaped louver bracket and an upper retaining plate, which are clamped over the louver side flange portions of the channel members by a nut-and-bolt retainer.

The channel assembly can be used interchangeably with any standard ledger of the type for which it is designed. The front coupling sleeve, likewise, can be used with any standard ledger. The present invention thus provides relatively simple and inexpensive components that are used with a standard ledger to extend the length of a span between adjacent load-supporting towers of a scaffolding system.

For a better understanding of the present invention, reference may be made to the following description of an exemplary embodiment, taken in conjunction with the accompanying drawings.

DESCRIPTION OF THE EMBODIMENT

Figure 3:
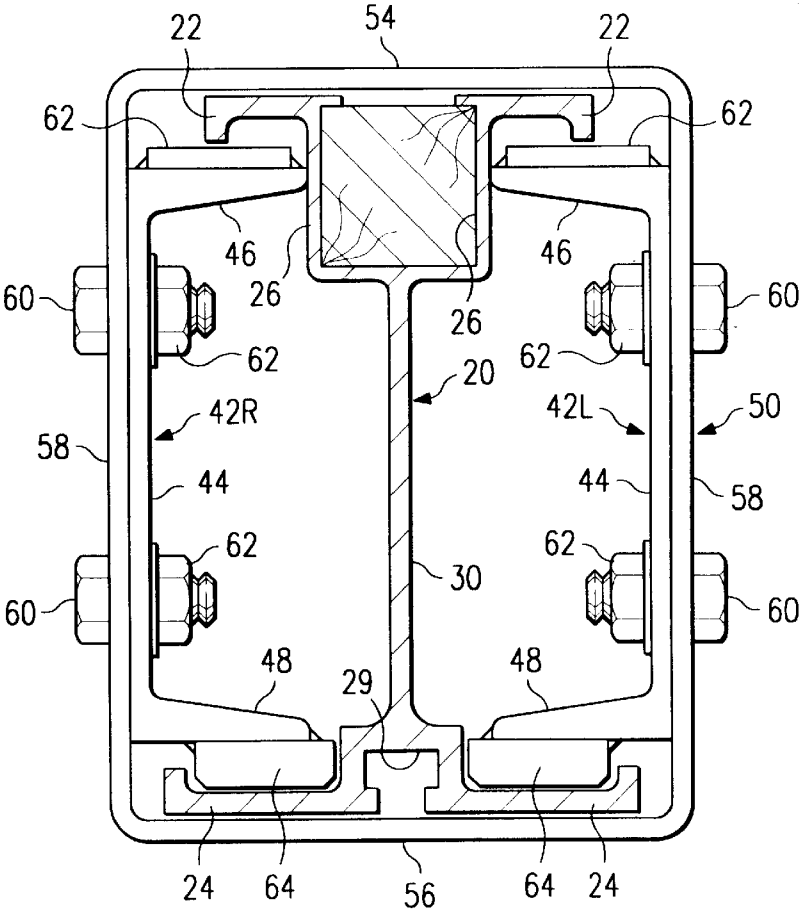
FIG. 3 is an end cross-sectional view of the telescopic ledger of FIG. 1, taken along the lines 3—3 of FIG. 1.

The embodiment of a telescopic ledger 10 shown in the drawings uses as its primary component an elongated ledger member 20, which is of standard design and is an aluminum extrusion of substantially uniform I-shape in cross-section along its length. The ledger member 20 has, in cross section (see FIG. 2 and 3), a pair of upper side flanges 22, a pair of lower side flanges 24, a U-shaped cavity 26 between and attached to the upper flanges that receives a wood nailing strip 28, to which decking is nailed, a bolt-head groove 29 that receives and captures the heads of bolts that in the usual use of the ledger joins the ledger to the landing channels of the scaffolding, and a web 30 that connects the base of the upper cavity and the roof of the bolt-head groove.

To convert a standard ledger into a telescopic ledger, a front coupling sleeve 32 (FIG. 2) is attached to the front end of the ledger member 20, and a channel assembly 40, which consists of a pair of identical elongated channel members 42L and 42R and a rear coupling sleeve 50 (FIG. 3) joining the channel members, is assembled to the ledger member 20 in telescoping relation.

The channel members 42 are aluminum extrusions of the same substantially uniform U-shaped cross section along their lengths; suitable channel members for the assembly 20 are commercially available as standard structural profiles. Each channel member 42 has a web portion 44 and upper and lower side flange portions 46 and 48 joined to and extending from side edges of the web portion. The rear ends of the channel members 42L and 42R are joined to each other in spaced-apart relation with their web portions in opposed relation opposite a cavity defined between them and with a gap between the ends of the upper and lower flange portions.

Figure 2:
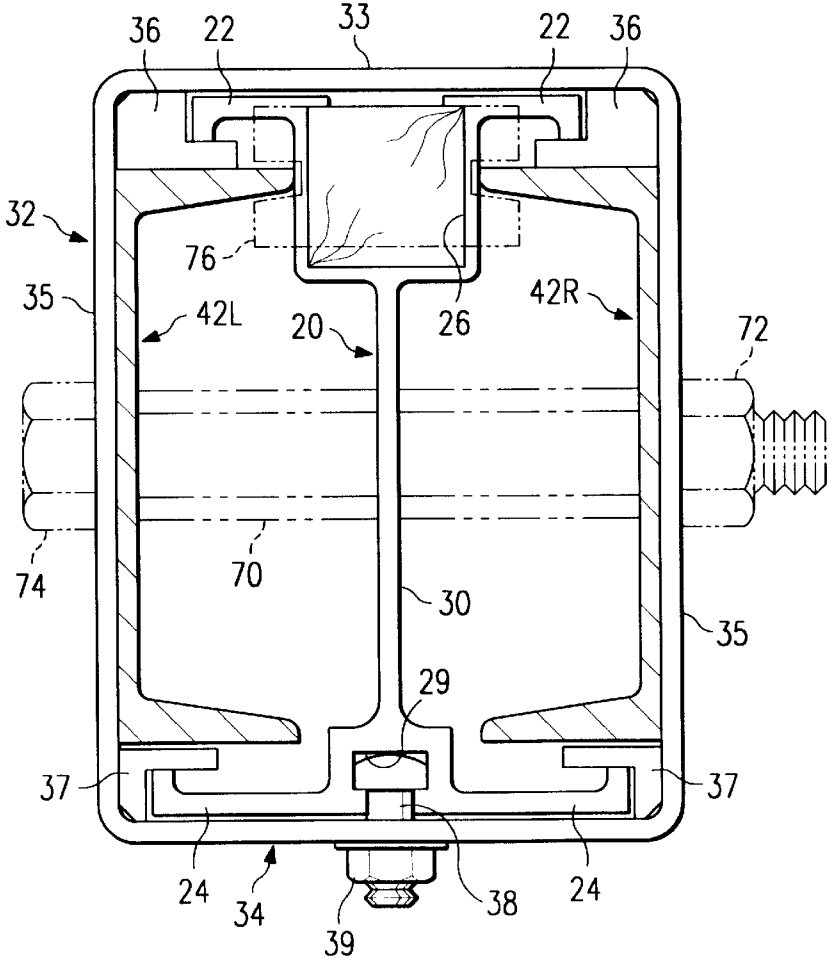
FIG. 2 is an end cross-sectional view of the telescopic ledger of FIG. 1, taken along the lines 2—2 of FIG. 1.

Referring to FIG. 2, the front coupling sleeve 32 includes a tubular body 34 of uniform rectangular cross section along its length. The upper and lower walls 33 and 34 are in close sliding fit with the upper and lower flange portions 22 and 24 of the ledger member so that the tubular body can be slid onto the end portion of the ledger 20. The side walls 35 are spaced apart from the flanges. Load transfers, both vertical and horizontal, between the front coupling sleeve 32 and the portions of the ledger member 20 and the channels 42L and 42R received within the tubular body 34 are provided for by welding upper packing blocks 36 and lower packing blocks 37 to the upper and lower corner portions of the body 34. The packing blocks are coextensive with the body 34. The front coupling sleeve 32 slides onto the end of the ledger member 20 and is affixed to the ledger member by two bolts 38, the heads of which are received in the bolt-head groove 29 of the ledger member and the shanks of which pass through holes in the body and receive washers and nuts 39. Note that the ledger member is not modified in any way to accept the front coupling sleeve 32, thus permitting it to be used interchangeably in the normal way or in a telescopic ledger 10.

The rear coupling sleeve 50 (FIG. 3) has a tubular body 52 of uniform rectangular cross section along its length and is, conveniently, identical to the tubular body 34 of the front coupling sleeve. The upper and lower walls 54 and 56 of the body 52 are in close sliding fit with the upper and lower flanges 22 and 24 of the ledger member 20. The channel members 42R and 42L are attached to the side walls 58 of the body 52 by bolts 60, which pass through holes in the body and the channel members and receive washers and nuts 62. Load transfers between the rear coupling sleeve 50 and the portions of the ledger member 20 and the channels 42L and 42R received within the tubular body 50 are provided for by welding upper packing blocks 62 and lower packing blocks 64 to the upper and lower flange portions 46 and 48 15 of the channel members 42. The packing blocks are coextensive with the body 52.

Figure 1:
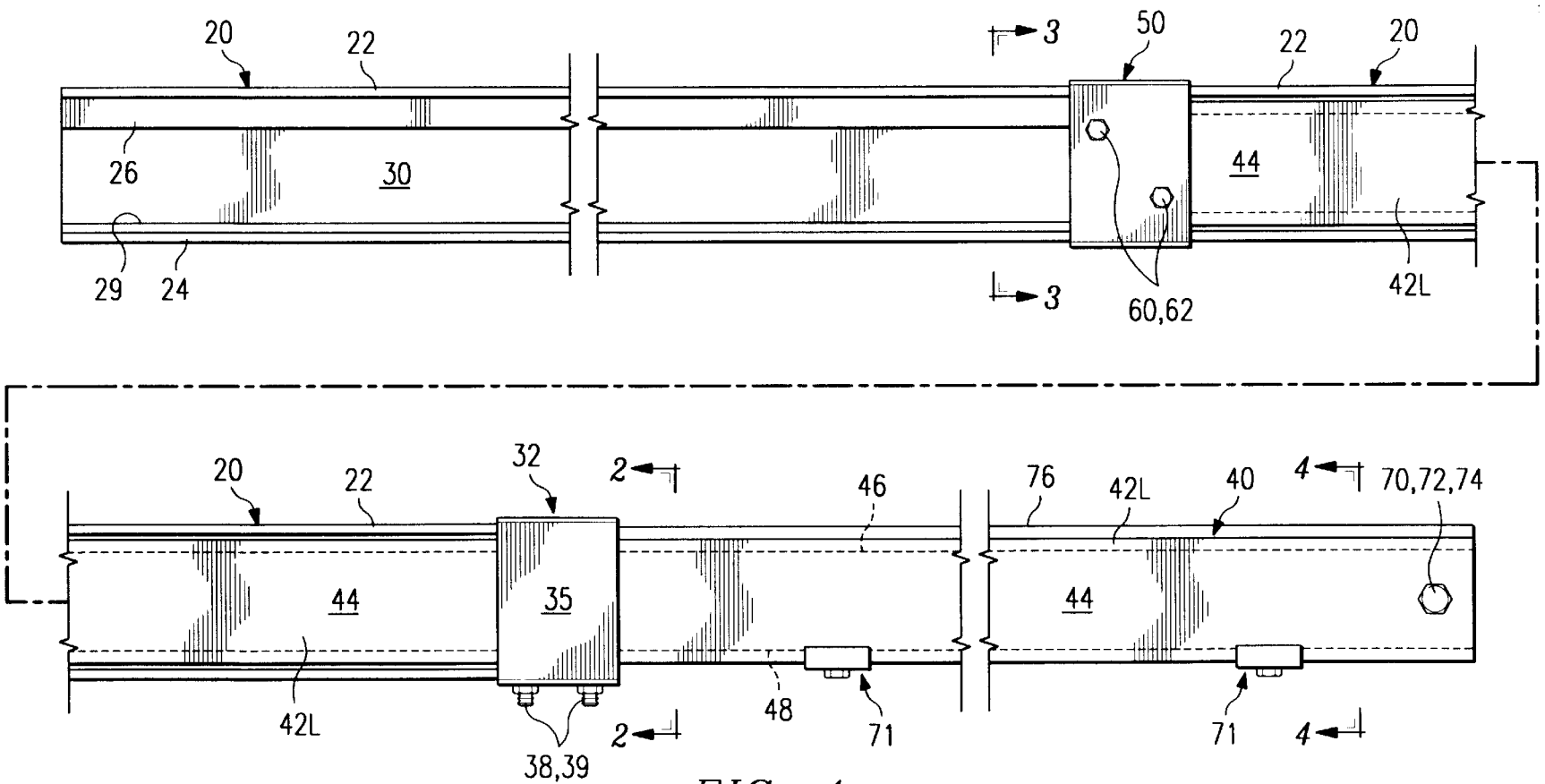
FIG. 1 is a side elevational view of an embodiment of a telescopic ledger embodying the present invention.

The channel assembly 40 and the front coupling sleeve 32 are, in essence, accessories that are used with standard ledgers to provide a telescopic long ledger for bridging longer than usual spans between scaffolding towers. They are field-assembled to standard ledgers by first installing the front coupling sleeve 32 on a ledger member 20, inserting the front, free end of the channel assembly 40 (the right end in FIG. 1) onto the rear free end of the ledger member (the left end in FIG. 1), and sliding the channel assembly along the major part of the length of the ledger member to the desired position, as shown in FIG. 1. The front free ends of the channel members 42R and 42L are then connected by a spacer tube 70, a bolt 72 and a nut 74 (shown in phantom lines in FIG. 2, inasmuch as they are in front of the plane of the cross-section).

Figure 4:
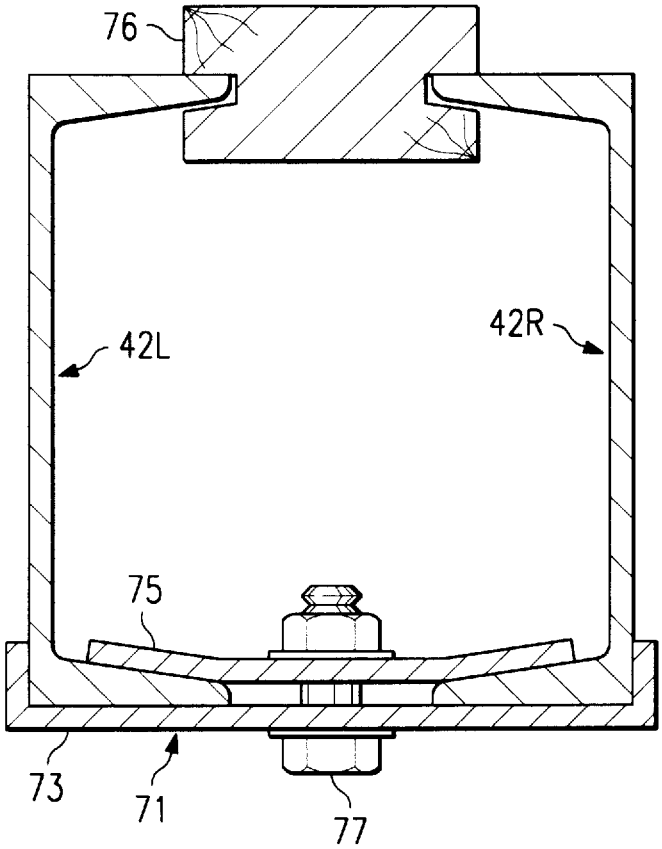
FIG. 4 is an end cross-sectional view of the telescopic ledger of FIG. 1, taken along the lines 4—4 of FIG. 1.

For greater lateral stiffening of the channel assembly 40, one or more spacer clips 71 (see FIG. 4) can be inserted between the channel members 42R and 42L. The spacer clip 71 preferably comprises a generally U-shaped lower bracket 73 and an upper retaining plate 75, which are clamped over the lower side flange portions 48 of the channel members 42R and 42L by a nut-and-bolt retainer 77.

After the channel assembly is installed on the ledger member, a wood nailing strip 76 of I-shaped cross section (shown in solid lines in FIG. 4 and in phantom lines in FIG. 2) of a suitable length to extend from the front coupling sleeve to the free front ends of the channel members is slid endwise into the gap between upper flanges 46 and the channel members 42L and 42R.

Typically, ledgers are 16 feet in length. The telescopic ledger can have a channel assembly of about 12 feet in length, which can overlap the ledger by from one to 10 feet. The coupling sleeves may be about six inches in length. The present invention is applicable not only to ledgers but to aluminum joists, which are often used in scaffolding. Accordingly, the term "ledger" is used in the summary and the claims as applying to structural members of I-shaped cross section. A ledger is essentially a form of "I" beam and equivalent to a joist.

I claim:

1. A telescopic ledger for scaffolding comprising an elongated ledger member of substantially uniform I-shape in cross section along its length;

a front coupling sleeve attached to the ledger member proximate to a front end of the ledger member; and a channel assembly having a pair of elongated channel members and a rear coupling sleeve attached to the channel members proximate to rear ends of the channel members;

the channel members being of the same substantially uniform U-shaped cross section along their lengths, each channel member having a web portion and side flange portions joined to and extending from side edges of the web portion, and the rear coupling sleeve joining the channel members in spaced-apart relation with their web portions in opposed relation opposite a cavity defined between the web portions and with the side flanges defining a gap;

a portion of the ledger member adjacent the front end of the ledger member being received in telescopic relation to portions of the channel members adjacent the rear ends of the channel members; and the front coupling sleeve and the channel assembly being in close sliding relation for transfer of loads from the channel members to the first coupling sleeve;

and the rear coupling sleeve and the ledger member being in close sliding relation for transfer of loads from the ledger member to the rear coupling sleeve.

2. A telescopic ledger according to claim 1 wherein the ledger member has a pair of upper side flanges and a pair of lower side flanges, and the respective channel members of the channel assembly are received between one upper flange and one lower flange of the ledger member.

3. A telescopic ledger according to claim 2 wherein the front coupling sleeve includes a tubular body of uniform rectangular cross section having upper and lower walls in close sliding fit with the upper and lower flanges of the ledger member.

4. A telescopic ledger according to claim 3 wherein the tubular body member of the front coupling sleeve further includes opposite side walls joining the upper and lower walls and forming corners and the front coupling sleeve further includes packing blocks affixed to the body member in the corners, the packing blocks being shaped and dimensioned to form a close sliding fit with the side flanges of the channel members.

5. A telescopic ledger according to claim 4 wherein the side walls of the tubular body member of the front coupling sleeve are in a close sliding fit with the web portions of the channel members.

6. A telescopic ledger according to claim 5 wherein the ledger member includes a bolt-head groove between the lower flanges and the front sleeve is affixed to the ledger member by at least one bolt received by the bolt-head groove, passing through a hole in the tubular body member, and receiving a nut.

7. A telescopic ledger according to claim 2 wherein the rear coupling sleeve includes a tubular body member that is uniform substantially rectangular cross section and has upper and lower walls that are in close sliding fit with the upper and lower flanges of the ledger member.

8. A telescopic ledger according to claim 7 wherein the tubular body member of the rear coupling sleeve has side walls joining the upper and lower walls and is fastened to the channel members by bolts passing through holes in the side walls of the body member and the webs of the channel members and nuts threaded onto the bolts.

9. A telescopic ledger according to claim 8 wherein portions of the side flanges of the channel members substantially coextensive with the body member of the rear coupling sleeve have packing blocks affixed to them, the packing blocks being in close sliding fit with the upper and lower flanges of the ledger member.

10. A telescopic ledger according to claim 1 wherein the channel members are connected by a spacer tube received between the webs of the channel members, a bolt passing through holes in the webs of the channel members and the spacer tube, and a nut threaded onto the bolt, the spacer tube and bolt being proximate to a front end of the channel assembly remote from the rear coupling sleeve.

11. A telescopic ledger according to claim 2 and further comprising a wood nailing strip of I-shaped cross section extending from the front coupling sleeve to the free front ends of the channel members and received in the gap between the lower side flanges of the channel members.

12. A telescopic ledger according to claim 2 and further comprising at least one spacer clip received between the lower side flanges of the channel members, the spacer clip including a generally U-shaped lower bracket and an upper retaining plate which are clamped over the lower side flange of the channel members by a nut-and-bolt retainer.

13. A telescopic ledger for scaffolding comprising an elongated ledger member of substantially uniform I-shape in cross section along its length and having a pair of upper side flanges and a pair of lower side flanges, a front coupling sleeve attached to the ledger member proximate to a front end of the ledger member, the front coupling sleeve including a tubular body of uniform rectangular cross section having upper and lower walls in close sliding fit with the upper and lower flanges of the ledger member; and a channel assembly having a pair of elongated channel members and a rear coupling sleeve attached to the channel members proximate to rear ends of the channel members, the rear coupling sleeve including a tubular body member of uniform substantially rectangular cross section and having upper and lower walls that are in close sliding fit with the upper and lower flanges of the ledger member;

the channel members being of the same substantially uniform U-shaped cross section along their lengths, each channel member having a web portion and side flange portions joined to and extending from side edges of the web portion, and the rear coupling sleeve joining the channel members in spaced-apart relation with their web portions in opposed relation opposite a cavity defined between the web portions and with the side flanges defining a gap;

a portion of the ledger member adjacent the front end of the ledger member being received in telescopic relation to portions of the channel members adjacent the rear ends of the channel members, the respective channel members of the channel assembly being received between one upper flange and one lower flange of the ledger member;

the front coupling sleeve and the channel assembly being in close sliding relation for transfer of loads from the channel members to the first coupling sleeve;

and the rear coupling sleeve and the ledger member being in close sliding relation for transfer of loads from the ledger member to the rear coupling sleeve.

14. A telescopic ledger according to claim 13 wherein the tubular body member of the front coupling sleeve further includes opposite side walls joining the upper and lower walls and forming corners and the front coupling sleeve further includes packing blocks affixed to the body member in the corners, the packing blocks being shaped and dimensioned to form a close sliding fit with the side flanges of the channel members.

15. A telescopic ledger according to claim 14 wherein the side walls of the tubular body member of the front coupling sleeve are in a close sliding fit with the web portions of the channel members.

16. A telescopic ledger according to claim 15 wherein the ledger member includes a bolt-head groove between the lower flanges and the front coupling sleeve is affixed to the ledger member by at least one bolt received by the bolt-head groove, passing through a hole in the tubular body member, and receiving a nut.

17. A telescopic ledger according to claim 13 wherein the tubular body member of the rear coupling sleeve has side walls joining the upper and lower walls and is fastened to the channel members by bolts passing through holes in the side walls of the body member and the webs of the channel members and nuts threaded onto the bolts.

18. A telescopic ledger according to claim 17 wherein portions of the side flanges of the channel members substantially coextensive with the body member of the rear coupling sleeve have packing blocks affixed to them, the packing blocks being in close sliding fit with the upper and lower flanges of the ledger member.

19. A telescopic ledger according to claim 13 wherein the channel members are connected by a spacer tube received between the webs of the channel members, a bolt passing through holes in the webs of the channel members and the spacer tube, and a nut threaded onto the bolt, the spacer tube and bolt being proximate to a front end of the channel assembly remote from the rear coupling sleeve.

20. A telescopic ledger according to claim 13 and further comprising a wood nailing strip of I-shaped cross section extending from the front coupling sleeve to the free front ends of the channel members and received in the gap between the lower side flanges of the channel members.

21. A telescopic ledger according to claim 13 and further comprising at least one spacer clip received between the lower side flanges of the channel members, the spacer clip including a generally U-shaped lower bracket and an upper retaining plate which are clamped over the lower side flange of the channel members by a nut-and-bolt retainer.

* * * * *

UNITED STATES PATENT AND TRADEMARK OFFICE

CERTIFICATE OF CORRECTION

PATENT NO. : 5,865,271

DATED : February 2, 1999

INVENTOR(S) : Alan J. Shalders

It is certified that error appears in the above-identified patent and that said Letters Patent is hereby corrected as shown below:

Col. 5, line 50, "comprising" should read --comprising:--;
Col. 6, line 6, "members; and" should read --members;--;

Col. 6, line 10, "and" (first occurrence) should be deleted;
Col. 6, line 43, "rectangular cross section" should read --rectangular in cross section--;
Col. 6, line 65, "and" should be deleted;
Col. 7, line 3, "and" should be deleted;
Col. 7, line 9, "comprising" should read --comprising:--;

Col. 7, line 19, "and" should be deleted;

Col. 8, line 15, "flanges" should read --flanges,--;
Col. 8, line 43, "and" should be deleted.

Signed and Sealed this

Twenty-fourth Day of October, 2000

*Attest:*

Q. TODD DICKINSON

*Attesting Officer*

*Director of Patents and Trademarks*